US007758043B2

(12) United States Patent
Keller

(10) Patent No.: US 7,758,043 B2
(45) Date of Patent: Jul. 20, 2010

(54) APPARATUS FOR THE TIMED DEFLECTION OF PLANAR OBJECTS

(75) Inventor: Alex Keller, Rapperswil (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 12/262,265

(22) Filed: Oct. 31, 2008

(65) Prior Publication Data

US 2009/0115119 A1 May 7, 2009

(30) Foreign Application Priority Data

Nov. 1, 2007 (CH) ..... 1698/07

(51) Int. Cl.
*B65H 5/00* (2006.01)

(52) U.S. Cl. ..... 271/225; 271/184

(58) Field of Classification Search ..... 271/184, 271/185, 225

See application file for complete search history.

(56) References Cited

U.S. PATENT DOCUMENTS

| | | | | |
|---|---|---|---|---|
| 4,201,377 | A * | 5/1980 | Honegger | 271/225 |
| 5,112,041 | A * | 5/1992 | Honegger | 271/286 |
| 5,449,165 | A * | 9/1995 | Naramore | 271/225 |
| 5,544,994 | A | 8/1996 | Simila | |
| 6,406,014 | B1 * | 6/2002 | Reist | 271/3.24 |
| 6,612,571 | B2 * | 9/2003 | Rider | 271/279 |
| 6,817,609 | B2 * | 11/2004 | Halvonik et al. | 271/228 |

FOREIGN PATENT DOCUMENTS

| | | |
|---|---|---|
| CH | 617 408 | 5/1980 |
| EP | 0 622 316 | 11/1994 |
| EP | 1 318 095 | 6/2003 |
| EP | 1 375 404 | 1/2004 |

OTHER PUBLICATIONS

Search Report for Swiss Application No. 2007 1698/07; Filed Nov. 1, 2007.

* cited by examiner

*Primary Examiner*—Kaitlin S Joerger
(74) *Attorney, Agent, or Firm*—Alston & Bird LLP

(57) ABSTRACT

By means of a feed conveyor (10), planar objects (12) accruing in an overlapping formation (S), in particular printed products, are fed to a deflecting device having at least one deflection member pair (24). This deflection member pair (24) has a deflection member (26) and a further deflection member (26') disposed below it. These form, synchronously with the cycle of the supplied objects (12) and starting from a passage gap, a transport gap (72), and then, again, the passage gap. Downstream of the passage gap and transport gap (72), viewed in the feed direction (Z), a stop (20) is present, against which the respective object (12) is brought to bear with its leading edge (16) through the passage gap. The transport gap (72) acts in the evacuation direction of an evacuating conveyor, to which the deflection member pair (24) feeds the objects (12) in a timed manner.

10 Claims, 3 Drawing Sheets

12
10
Z,V1
34
16
K
S
36
16
22
32
36
30
S'
A
B
α
W'
L
W,V2
12'
74
26
24
28
20
18
24
28
14

Z,V1
12
38
38
34
10
36
16
30
S'
S
22
38'
W,V2
α''
α'
W'
38'
36
32
26
24'
28
20
18
74
14
26
24
28

APPARATUS FOR THE TIMED DEFLECTION OF PLANAR OBJECTS

BACKGROUND OF THE INVENTION

The present invention relates to an apparatus for conveying planar objects, in particular printed products accrued in an overlapping formation.

An apparatus of this type is known, for example, from patent specifications CH 617 408 and U.S. Pat. No. 4,201,377. Placed downstream of a feed conveyor is an evacuating conveyor running at an angle thereto. The outlet of the feed conveyor is disposed on one side of the evacuating conveyor and, at a distance from the outlet of the feed conveyor, above the evacuating conveyor, there is assigned to the latter a circumferential deflection member, which forms with the evacuating conveyor a transport gap that tapers in the feed direction of the feed conveyor and acts in transport terms equidirectionally with (i.e., in a direction parallel to) the evacuation direction of the evacuating conveyor. The apparatus is suitable, in particular, for conveying printed products accrued in an overlapping stream, since the overlapping stream is maintained, while only the orientation of the individual printed products within the overlapping stream changes.

In addition, from EP 0 718 226 A, a feed deflection apparatus for at least partially folded newspapers and magazines is known, in which the feed direction of the newspapers is deflected through 90°. The apparatus has a pair of stop cylinders and a pair of acceleration cylinders, which pairs lie substantially in one plane but at an angle of 90° to each other. They are provided with sector-shaped lugs in order to keep the newspaper or magazine between them pressed when the lugs of both cylinders of the cylinder pairs are on a line between the center axes. By means of the stop cylinders, the respective newspaper or magazine is arrested or stopped by controlled slowing of the cylinders such that no slippage of the newspapers between the pair of stop cylinders occurs. The pair of acceleration cylinders grasps the side margin, viewed in the feed direction, of the newspaper or magazine at the moment at which the newspaper or magazine is stopped by means of the pair of stop cylinders. This feed deflection apparatus is suitable solely for handling newspapers or magazines which accrue at a distance apart one behind the other. The object of the present invention is to refine the apparatus of the generic type such that the accrued objects are deflected in a timed manner.

BRIEF SUMMARY OF THE INVENTION

This object is achieved with an apparatus in which a deflection member and a further deflection member interacting therewith form a passage gap through which the respective supplied object can be conveyed with its leading edge against a stop. This ensures that the object adopts a defined position. In synchronization with the cycle of the feed conveyor, the two deflection members for the respective object bearing against the stop form a transport gap so as to feed this object to the evacuating conveyor. The objects are thus deflected in time with the feed conveyor and fed to the evacuating conveyor. Since the deflection members take hold of the respective object in a marginal portion adjacent to the leading edge, the conveyance and timed deflection of objects accrued in an overlapping formation, in particular printed products, is enabled.

BRIEF DESCRIPTION OF THE DRAWINGS

The invention is described in greater detail below with reference to illustrative embodiments represented in the drawing, wherein, in purely schematic representation.

DETAILED DESCRIPTION OF THE DRAWINGS

Figure 1:
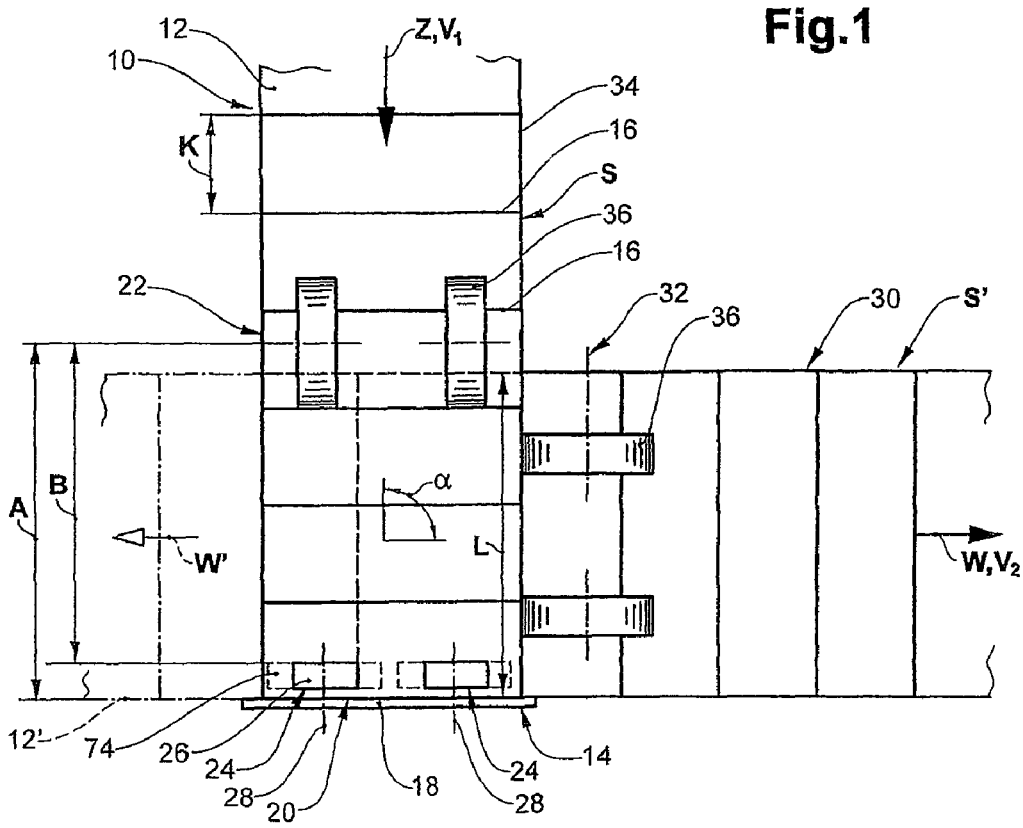
FIG. 1 shows in top view an apparatus according to the invention, in which a feed conveyor and an evacuating conveyor run at a right angle to each other.

FIG. 1 shows in top view a first embodiment of an apparatus according to the invention during operation. It has a feed conveyor 10, which is intended to feed planar objects 12, in the present case printed products, e.g. newspapers, magazines or the like, in the feed direction Z to a deflecting device 14. The objects 12 are arranged in an overlapping formation S, in which the objects 12 rest in an overlapping manner on the respectively leading object and the leading edge 16 of the objects in the feed direction Z runs at least approximately at right angles to the feed direction Z. The distance K between the leading edges 16 of successive objects 12 is at least approximately constant, so that, at a specific transport velocity v1 of the feed conveyor 10, respectively one object 12 in each work cycle is fed to the deflecting device 14. The feed conveyor 10 is continuously driven and feeds the deflecting device 14 with objects 12 in a timed manner.

The deflecting device 14 has a stop 20, formed by a stop bar 18, for the leading edge 16 of the objects 12. The stop bar 18 runs at right angles to the feed direction Z and thus at least approximately parallel to the leading edge 16 of the supplied objects 12 and is disposed at a distance A from the outlet 22 of the feed conveyor 10 which is at least equal in size to the extent (length) L of the objects measured in the feed direction Z. Preferably, the distance A is, for example, 5 to 10% greater than the extent L.

In addition, the deflecting device 14 has two deflection member pairs 24, 24', which—viewed in the feed direction Z—are disposed at a distance B from the outlet 22 and upstream of the stop bar 18. The distance B is preferably somewhat smaller than the extent L of the objects 12.

Each deflection member pair 24, 24' has two pulley-like deflection members 26, 26' disposed one above the other in the vertical direction, which are mounted rotatably about rotation axes 28 running parallel to the feed direction Z and thus at right angles to the leading edge 16 of the objects 12. As shall be described further below, the deflection members 26, 26' of each deflection pair 24, 24', coordinated with the cycle of the objects 12 supplied by the feed conveyor 10, and starting from a passage gap, form a transport gap through which the objects 12 are transported equidirectionally with (i.e., in a direction parallel to) the evacuation direction W of an evacuating conveyor 30. The feed conveyor 10 and the evacuating conveyor 30 are arranged at an angle a of 90° to each other, so that the feed direction Z and the evacuation direction W run at a right angle to each other. The inlet 32 of the evacuating conveyor 30 is located, viewed in the evacuation direction W, downstream of the deflecting device 14, and at such a distance from that side edge 34 of the objects 12 fed to the deflecting device 14 in the feed direction Z which is facing the evacuating conveyor 30 that these objects, without action of the deflecting device 14, are not influenced by the evacuating conveyor 30.

Both the feed conveyor 10 and the evacuating conveyor 30 are configured as a belt conveyor, with which, close to the outlet 22 and inlet 32 respectively, two weight rollers 36 interact.

The objects 12 supplied in the work cycle of the deflecting device 14, having butted against the stop 20, are deflected by means of the deflection member pair 24, 24' and fed in the evacuation direction W to the evacuating conveyor 30, the objects 12 maintaining a mutually parallel position. As a result of the deflection, the side edge 34 thus becomes the leading edge. Since the evacuating conveyor 30 is driven continuously and at an evacuation velocity v2 matched to the feed velocity v1, and the objects 12 are deflected by means of the deflecting device 14 in a timed manner, an again regular, timed overlapping stream S' is formed.

The dashed arrow W' indicates that the evacuating conveyor 30, viewed in the feed direction Z, can be disposed on the other side in order to evacuate the deflected objects 12 in the evacuation direction W' opposite to the evacuation direction W. For this purpose, of course, the rotational directions of the deflection members 26 are reversed. It is also conceivable to provide two evacuating conveyors 30, whereof one acts in the evacuation direction W and the other in the evacuation direction W'. This allows an evacuation of the deflected objects 12 in the evacuation direction W or W', depending on the working direction of the deflecting device 14.

In the case of the objects 12 shown with solid lines, the extent L is greater than the width measured at right angles to the feed direction Z. It is also possible, however, to handle rectangular objects 12 whose extent L is smaller than the width, as is indicated with the printed products 12' shown in dash-dot representation. For adaptation to those formats of the objects 12 which are to be handled, the distances A, B between the outlet 22 of the feed conveyor 10 and the stop 20 and deflection members 26 respectively are adjustable.

Figure 2:
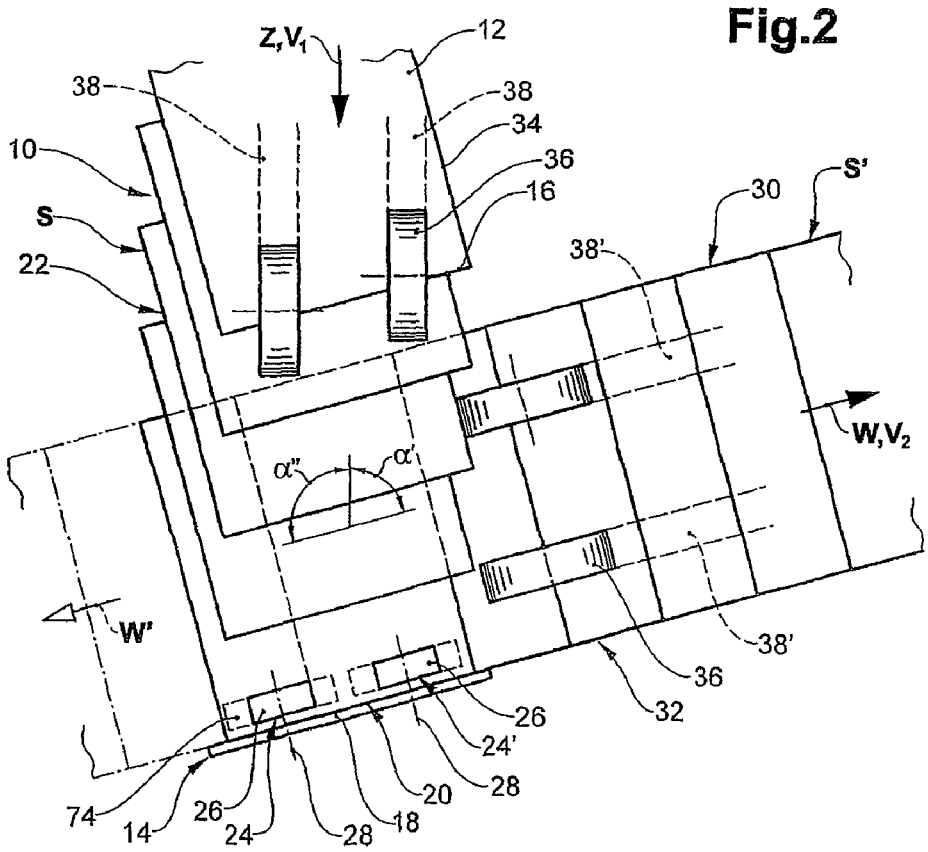
FIG. 2 shows in top view a further embodiment of the apparatus according to the invention, in which the feed conveyor and the evacuating conveyor are arranged at an angle of other than 90° to each other.

FIG. 2 shows in the same representation as FIG. 1 an apparatus according to the invention, in which the angle $\alpha'$ or $\alpha''$ between the feed direction Z and the evacuation direction W, W' is less or greater than 90°. The planar objects 12 are once again fed to the deflecting device 14 in a timed manner, in an overlapping formation S, by means of the feed conveyor 10. The leading edge 16 of the objects 12 is orientated parallel to the evacuation direction W or evacuation direction W' and parallel to the stop bar 18; it thus likewise forms with the feed direction Z an angle corresponding to the angle $\alpha'$ or $\alpha''$. The objects 12 are thus conveyed in a type of "diagonal overlap" S, wherein the mutually corresponding corners of the planar objects 12 lie on straight lines running in the feed direction Z. As a result of the deflection, from the "diagonal overlap" a normal overlapping stream S' is formed, in which, once again, the former side edge 34 becomes the leading edge, which runs at right angles to the evacuation direction W. In addition to the slant of the deflecting device 14 with respect to the feed direction Z, its distance from the outlet 22 of the feed conveyor 10 is correspondingly adjustable.

Also in the embodiment shown in FIG. 2, the feed conveyor 10 and evacuating conveyor 30 are preferably configured as belt conveyors. In order to make possible the outlet 22 and inlet 32, which run obliquely with respect to the feed direction Z and evacuation direction W respectively, the belt of the belt conveyors can be formed by parallel-running ribbons 38, 38', which are guided around deflection rollers mounted offset in accordance with the slant in the feed direction Z or evacuation direction W. This offset is visible with reference to the weight rollers 36, which are correspondingly mounted and interact with the ribbons 38, 38'. Otherwise the apparatus shown in FIG. 2 is of the same configuration and works in the same way as the embodiment in FIG. 1.

Figure 3:
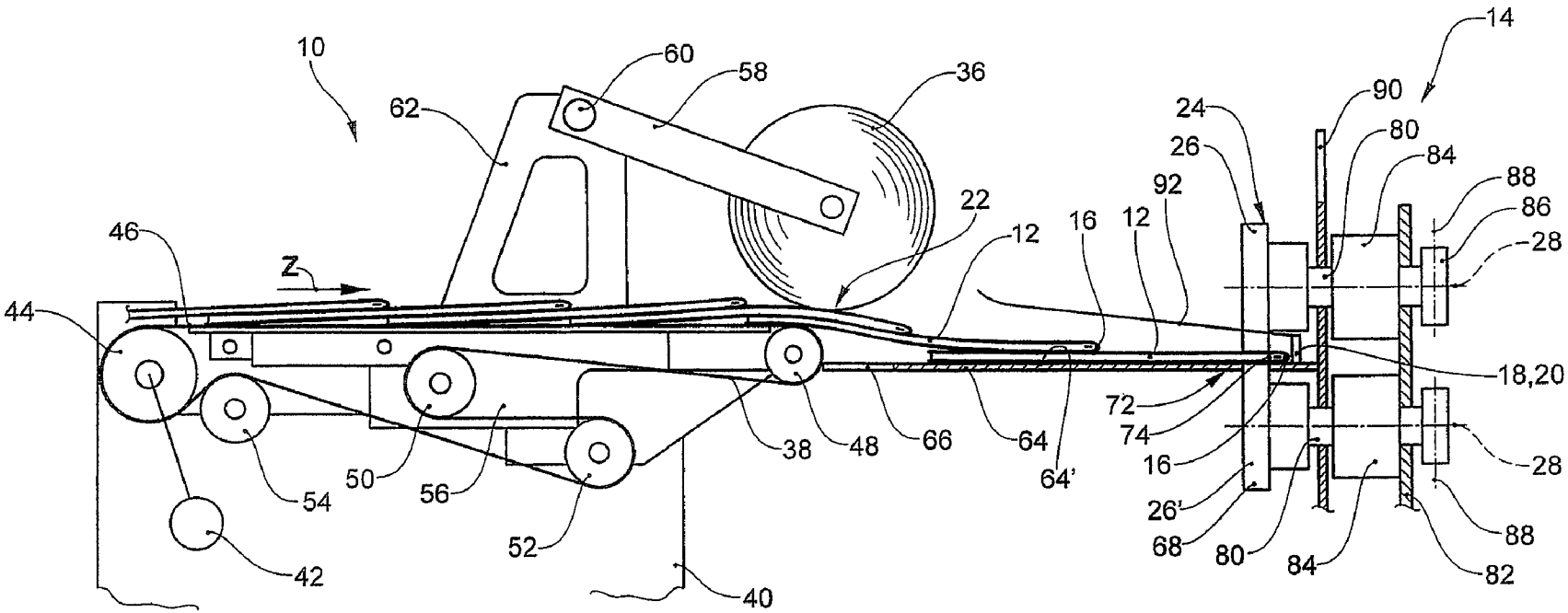
FIG. 3 shows in side view, and partially in section, the feed conveyor configured as a telescopic belt conveyor, and a deflecting device.

The feed conveyor 10 configured as a belt conveyor preferably has two or more parallel-guided ribbons 38, of which one is visible in FIG. 3. Viewed in the feed direction Z, this is guided on the upstream-situated end of the feed conveyor 10 around a drive roll 44, which is rotatably mounted on a machine frame 40 and is driven by means of an electric motor 42. From the drive roll 44, the ribbon 38 runs in the feed direction Z, forming the active strand 46, to an outlet roll 48 disposed close to the outlet 22 and around said outlet roll through about 180°. After this, the ribbon 38 is guided in an S-shape around a first compensating roll 50 and second compensating roll 52. From the latter, the ribbon 38 runs to a deflection roll 54, which ensures that the ribbon bears with a large wrap angle against the drive roll 44. While the drive roll 44, the second compensating roll 52 and the deflection roll 54 are mounted fixedly on the machine frame 40, the outlet roll 48 and the first compensating roll 50 are mounted in a freely rotatable manner on a slide 56, which is disposed on the machine frame 40 such that it is displaceable in and counter to the feed direction Z. In the embodiment shown in FIG. 3, the feed conveyor 10 is configured as a telescopic belt conveyor to allow the position of the outlet 22 relative to the deflecting device 14 to be adjusted in dependence on the extent L of the planar objects 12 to be handled.

The weight rollers 36 which interact with the ribbons 38 in the region of the outlet rolls 48 are each mounted in a freely rotatable manner on the free end of a lever 58, which at the other end is disposed in a freely pivotable manner on a bearing shaft 60. The bearing shaft 60 spans the feed conveyor 10 and is fastened on both sides to a shield 62 protruding upward from the slide 56.

The weight rollers 36 roll on the top side of the objects 12 and ensure that these are transported by the feed conveyor 10, without slippage, up to the point of release close to the outlet 22.

Extending horizontally between the feed conveyor 10 and the deflecting device 14 is a supporting plate 64, which forms a stationary rest surface 64' for the objects 12. In order that the friction between the object 12 released from the feed conveyor 10 and fed to the deflecting device 14—which object, in FIG. 3, rests flat on the supporting plate 64—and the following object 12 can be kept to a minimum, the rest surface 64' is preferably located at some distance below the outlet 22, so that there, in the path of conveyance, a downward-sloping step is formed. This too helps to keep the friction of the objects 12 with the supporting plate 64 low, such that the object 12 respectively released at the outlet 22 reliably comes to bear with its leading edge 16 against the stop bar 18 forming the stop 20. This is also aided by the respectively following, supported object 12; by virtue of the overlapping formation S, a movement of the objects 12 away from the stop 20, counter to the feed direction Z, is also prevented.

In the end region facing the feed conveyor 10, the supporting plate 64 has recesses 66, into which the slide 56 can telescope with the outlet rolls 48. Further recesses on the supporting plate 64 are provided close to the deflecting device 14 to allow the respectively bottom-situated further deflection members 26' of the two deflection member pairs 24, 24' to reach through.

Figure 4:
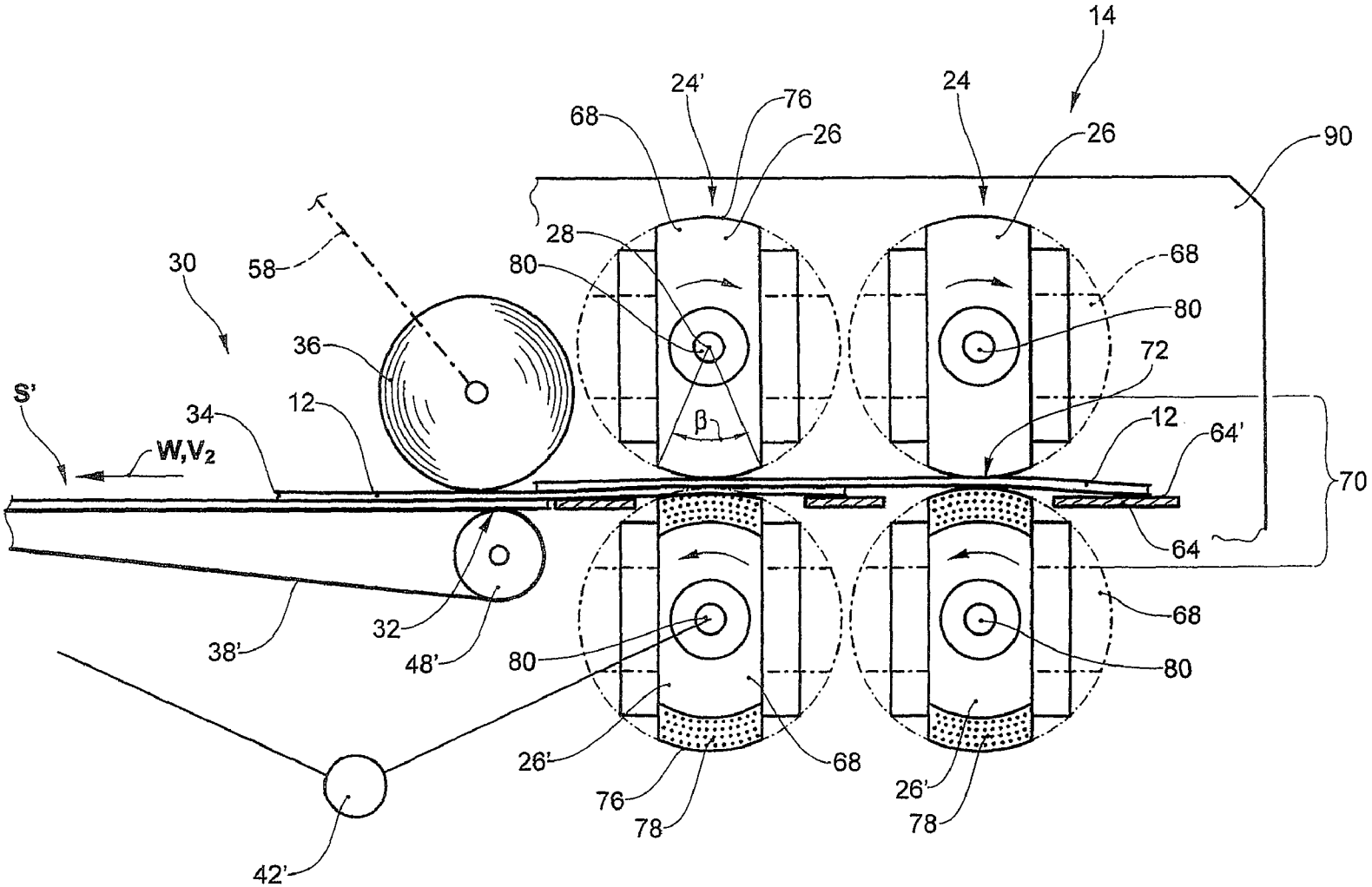
FIG. 4 shows in projection the deflecting device and a part of the evacuating conveyor.

As emerges in particular from FIG. 4, each of the deflection member pairs 24, 24' has an upper deflection member 26 and a lower further deflection member 26'. The deflection members 26 and further deflection members 26' are configured as circular conveyor pulleys 68, on which two diametrically opposing portions are recessed.

In the shown example and viewed in projection, the two top-situated deflection members 26 are driven clockwise and the lower further deflection members 26 counterclockwise.

The drive is realized continuously and synchronously by means of a further electric motor 42'. In the rotation position indicated with dash-dot lines in FIG. 4, the deflection member pairs 24, 24' form a passage gap 70. In the rotation position shown with solid lines, they form a substantially narrower transport gap 72, in which the object 12 which is respectively bearing with its leading edge 16 against the stop 20 is grasped and held in a preferably slip-free manner in a marginal portion 74 adjacent to the leading edge 16—see also FIG. 1.

In order to maintain the greatest possible friction between the transport-active surfaces 76 of the conveyor pulley 68 which are in the shape of a cylinder casing segment, in the illustrative embodiment shown in FIG. 4 the bottom situated conveyor pulleys 68 have on the casing side a relatively soft lining 78 having a high friction coefficient with respect to the objects 12 to be conveyed. Preferably, the lining 78 is of relatively thick configuration and that part of the conveyor pulley 68 which supports the lining 78 is configured correspondingly smaller in diameter. This ensures a secure holding of the objects 12 in the transport gap 72 and, at the same time, a smooth running of the apparatus. The different thickness of the formed overlapping formation S' can be received with little noise and without damage to the objects 12.

The deflection members 26 and further deflection members 26' are each fastened on the end face to a drive shaft 80 which is arranged coaxially to the particular rotation axis 28 and which, for its part, is mounted in parallel-axial arrangement on bearings 84 fastened to an end shield 82 of the machine frame 40 (see also FIG. 3). Seated in a rotationally secure manner on the drive shafts 80 are drive wheels 86, around which drive belts 88 are guided. These are connected directly or via a reversing gearing to the further electric motor 42'.

For the sake of completeness, it should be mentioned that the stop bar 18 is fastened to the supporting plate 64 and, viewed in the feed direction Z, is disposed downstream of the deflection members 26 and the particular conveyor pulleys 68, as well as between these and a protective wall 90 of the machine frame 40, which protective wall is penetrated by the drive shafts 80. The transport gap 72 acts in the evacuation direction W of the evacuating conveyor 30.

The evacuating conveyor 30 is preferably configured the same as the feed conveyor 10 and is driven by the further electric motor 42'. For the sake of greater clarity, of the evacuating conveyor 30 only an inlet roll 48', which corresponds to the outlet roll 48 of the feed conveyor 10 and is mounted in a freely rotatable manner on the slide of the evacuating conveyor 30 and around which a ribbon 38' is guided, as well as the particular weight roller 36 which interacts with this ribbon 38', is represented in FIG. 4. In the evacuating conveyor 30, of course, the ribbons 38' are driven, compared with the feed conveyor 10, in the opposite direction W and continuously at the evacuation velocity v2. The electric motors 42, 42' are synchronized with each other in the desired phasing in known manner.

As shown in FIG. 3, above the supporting plate 64 there can be arranged an inlet plate 92, which, together with the supporting plate 64, forms a narrowing inlet gap for the objects 12 to be fed to the deflecting device 14. In addition, the supporting plate 64 has further recesses, corresponding to the recesses 66, for the evacuating conveyor 30.

In FIG. 4, β denotes the rotation angle via which a deflection member pair 24, 24' respectively transport gap 72 for the object 12 to be deflected and to be fed to the evacuating conveyor 30. The peripheral velocity of the deflection members 26, further deflection members 26' or conveyor pulleys 68 corresponds to the transport velocity v2 of The evacuating conveyor 30. The working method of the apparatus is as follows:

The planar objects 12 are fed in a regular overlapping formation S by means of the feed conveyor 10 in the machine cycle of the deflecting device 14. Within one machine cycle, the deflection members 26 and further deflection members 26' make a 180° rotation in the rotation directions indicated with arrows in FIG. 4. While the deflection members 26 and further deflection members 26' form the passage gap 70, respectively one object 12, with its leading edge 16 to the fore, moves through between the deflection members 26 and further deflection members 26', until it comes to bear with its leading edge 16 against the stop 20 formed by the stop bar 18 and is braked to a stop. The phasing of the deflection members 26 and further deflection members 26' relative to the feed conveyor 10 is set such that the transport gap 72 is formed, as far as possible, at the moment at which the particular object 12 comes to bear against the stop 12. As soon as the transport gap 72 is formed, the object 12 is accelerated very rapidly to the transport velocity of the evacuation conveyor 30 and is fed to the latter in the evacuation direction W in a timed manner.

It is also conceivable to recess respectively just a single segment on the conveyor pulleys 68. In this case, however, the deflection members 26 and further deflection members 26' must perform a complete rotation in each machine cycle, which means that the diameter of the conveyor pulleys 68 must be chosen to be half as large as in the embodiment according to FIG. 4.

It is further conceivable to configure the bottom-situated conveyor pulleys 68 of the further deflection members 26' as solid pulleys, without cut-away segments, and to configure the conveyor pulleys 68 of the top-situated deflection members 26 with one or two cut-away segments.

It should be mentioned that it is also possible to configure the conveyor pulleys 68 both of the deflection members 26 and of the further deflection members 26' as solid pulleys and to move conveyor pulleys 68 of the deflection member pairs 24, 24', in the machine cycle, up to and away from each other to form, at the least distance apart, the transport gap, and at a comparatively greater distance apart, the passage gap.

The apparatus according to the invention functions also with a single deflection member pair.

It is also possible to provide all conveyor pulleys 68 with a flexible lining 78.

With the apparatus according to the invention, in addition to newspapers, magazines and the like, single sheets and other planar objects which are also accrued in an overlapping stream can be handled. The objects 12 can also be supplied and deflected singly, at a mutual distance apart. The single evacuation and the formation of an overlapping stream S' is herein possible. By planar object should also be understood an object consisting of two or more parts arranged one on top of the other. Should these have different formats, their leading edges will preferably lie close together.

What is claimed is:

1. An apparatus for conveying planar objects, in particular printed products accrued in an overlapping formation (S), having a feed conveyor, an evacuating conveyor running at an angle ($\alpha$, $\alpha'$, $\alpha''$) to a feed direction (Z) of said feed conveyor, and at least one pair of rotatably mounted first and second deflection members disposed at a distance (B) from an outlet of the feed conveyor, the first and second deflection members forming a transport gap therebetween through which the objects are transported in a direction parallel to an evacuation direction (W) of the evacuating conveyor, the deflection members being rotated synchronously with the cycle of the objects supplied, from a first position forming a passage gap therebetween, to a second position forming the transport gap, and then again to the first position, wherein the deflection members disposed in the first position allow each respective object to be fed from the feed conveyor through the passage gap, and the apparatus further comprises a stop, disposed downstream of the passage gap in the feed direction (Z), such that the leading edge of each respective object in the feed direction (Z) abuts the stop after first having passed through the passage gap, whereupon the deflection members rotated to the second position take hold of the respective object in a leading edge marginal portion of the object in the feed direction (Z) and transport the object through the transport gap.

2. The apparatus as claimed in claim 1, wherein the deflection members are continuously driven.

3. The apparatus as claimed in claim 1, wherein the deflection members are configured as conveyor pulleys and at least on one of the conveyor pulleys a segment is recessed to form the passage gap.

4. The apparatus as claimed in claim 3, wherein on each conveyor pulley two mutually diametrically opposing segments are recessed.

5. The apparatus as claimed in claim 1, wherein at least one of the deflection members is provided on a casing side with a flexible lining.

6. The apparatus as claimed in claim 1, wherein a distance (A) between the outlet of the feed conveyor and the stop corresponds at least to the extent (L) of the objects measured in the feed direction (Z).

7. An apparatus for conveying planar objects, in particular printed products accrued in an overlapping formation (S), having a feed conveyor, an evacuating conveyor running at an angle ($\alpha$, $\alpha'$, $\alpha''$) to a feed direction (Z) of said feed conveyor, and at least one pair of rotatably mounted first and second deflection members disposed at a distance (B) from an outlet of the feed conveyor, the first and second deflection members forming a transport gap therebetween through which the objects are transported in a direction parallel to an evacuation direction (W) of the evacuating conveyor, the deflection members being rotated synchronously with the cycle of the objects supplied, from a first position forming a passage gap therebetween, to a second position forming the transport gap, and then again to the first position, wherein the deflection members disposed in the first position allow each respective object to be fed from the feed conveyor through the passage gap, and the apparatus further comprises a stop, disposed downstream of the passage gap in the feed direction (Z), such that the leading edge of each respective object in the feed direction (Z) abuts the stop after first having passed through the passage gap, whereupon the deflection members rotated to the second position take hold of the respective object in a leading edge marginal portion of the object in the feed direction (Z) and transport the object through the transport gap, wherein the feed conveyor and the evacuating conveyor are configured as telescopic belt conveyors.

8. An apparatus for conveying planar objects, in particular printed products accrued in an overlapping formation (S), having a feed conveyor, an evacuating conveyor running at an angle ($\alpha$, $\alpha'$, $\alpha''$) to a feed direction (Z) of said feed conveyor, and at least one pair of rotatably mounted first and second deflection members disposed at a distance (B) from an outlet of the feed conveyor, the first and second deflection members forming a transport gap therebetween through which the objects are transported in a direction parallel to an evacuation direction (W) of the evacuating conveyor, the deflection members being rotated synchronously with the cycle of the objects supplied, from a first position forming a passage gap therebetween, to a second position forming the transport gap, and then again to the first position, wherein the deflection members disposed in the first position allow each respective object to be fed from the feed conveyor through the passage gap, and the apparatus further comprises a stop, disposed downstream of the passage gap in the feed direction (Z), such that the leading edge of each respective object in the feed direction (Z) abuts the stop after first having passed through the passage gap, whereupon the deflection members rotated to the second position take hold of the respective object in a leading edge marginal portion of the object in the feed direction (Z) and transport the object through the transport gap, wherein two pairs of deflection members are disposed one behind the other in the evacuation direction (W).

9. The apparatus as claimed in claim 1, wherein, between the outlet of the feed conveyor and the deflection members, a stationary bearing surface for the objects is present.

10. A method for conveying planar objects, in particular printed products accrued in an overlapping formation (S), in which the objects are fed by means of a feed conveyor in a feed direction (Z) to a deflection member disposed at a distance (B) from an outlet of the feed conveyor and are deflected by means of the deflection member, which serves to form a transport gap acting equidirectionally with an evacuation direction (W) of an evacuating conveyor running at the angle ($\alpha$, $\alpha'$, $\alpha''$) to the feed conveyor, wherein the objects are conveyed with their leading edges through a passage gap formed by the deflection member and a further deflection member, against a stop, are then grasped in a leading edge marginal portion by means of the deflection member and the further deflection member, the deflection members forming the transport gap synchronously with the cycle of the supplied objects, and are fed to the evacuating conveyor.

* * * * *